US010375792B2

(12) United States Patent
Uenoyama et al.

(10) Patent No.: US 10,375,792 B2
(45) Date of Patent: Aug. 6, 2019

(54) LUMINAIRE AND LIGHTING CONTROL METHOD

(71) Applicant: Panasonic Intellectual Property Management Co., Ltd., Osaka (JP)

(72) Inventors: Koji Uenoyama, Kyoto (JP); Yuichirou Hirowatari, Osaka (JP); Shinichi Murakami, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/141,078

(22) Filed: Sep. 25, 2018

(65) Prior Publication Data

US 2019/0104590 A1 Apr. 4, 2019

(30) Foreign Application Priority Data

Sep. 29, 2017 (JP) ..... 2017-189442

(51) Int. Cl.

| | |
|---|---|
| ***H05B 33/08*** | (2006.01) |
| ***F21S 2/00*** | (2016.01) |
| ***H05B 37/02*** | (2006.01) |
| *F21Y 115/10* | (2016.01) |

(52) U.S. Cl.

CPC ..... *H05B 33/0863* (2013.01); *F21S 2/005* (2013.01); *H05B 37/0209* (2013.01); *F21Y 2115/10* (2016.08)

(58) Field of Classification Search

CPC ..... H05B 33/0845; H05B 33/0857; H05B 33/0863

USPC ..... 315/307

See application file for complete search history.

(56) References Cited

U.S. PATENT DOCUMENTS

| | | | | |
|---|---|---|---|---|
| 2013/0162172 | A1* | 6/2013 | Baaijens | H05B 33/0863 315/292 |
| 2014/0070707 | A1 | 3/2014 | Nagazoe | |
| 2014/0265864 | A1* | 9/2014 | Hickok | H05B 37/02 315/132 |
| 2015/0212705 | A1* | 7/2015 | Sasaki | G06F 3/04817 715/777 |
| 2016/0174325 | A1* | 6/2016 | Monjo | H05B 33/0863 315/130 |

(Continued)

FOREIGN PATENT DOCUMENTS

| | | |
|---|---|---|
| JP | H03-025897 A | 2/1991 |
| JP | 2011-014341 A | 1/2011 |

(Continued)

*Primary Examiner* — Tung X Le

(74) *Attorney, Agent, or Firm* — McDermott Will & Emery LLP

(57) ABSTRACT

A luminaire includes: a light source configured to emit light in a plurality of different colors; a controller that controls the color of the light emitted by the light source; and a plurality of buttons that correspond one-to-one with the plurality of different colors and are operated by a user to cause the light source to emit light. Each time one of the buttons is operated, the controller stores a control parameter associating the color corresponding to the button operated with a sequence value indicating a sequential order in which the button is selected. The controller changes the color of the light emitted by the light source in accordance with the colors and the sequential order indicated in the stored control parameter.

17 Claims, 11 Drawing Sheets

(56) References Cited

U.S. PATENT DOCUMENTS

| | | | | |
|---|---|---|---|---|
| 2016/0323972 | A1* | 11/2016 | Bora | H05B 33/0842 |
| 2018/0075714 | A1* | 3/2018 | Sooch | G08B 5/36 |

FOREIGN PATENT DOCUMENTS

| | | | |
|---|---|---|---|
| JP | 2012-069422 | A | 4/2012 |
| JP | 2014-056670 | A | 3/2014 |
| JP | 2015-097168 | A | 5/2015 |

* cited by examiner

LUMINAIRE AND LIGHTING CONTROL METHOD

CROSS REFERENCE TO RELATED APPLICATION

This application claims the benefit of priority of Japanese Patent Application Number 2017-189442 filed on Sep. 29, 2017, the entire content of which is hereby incorporated by reference.

BACKGROUND

1. Technical Field

The present disclosure relates to a luminaire and a lighting control method.

2. Description of the Related Art

A dimming control device that includes a display for displaying lighting buttons corresponding to luminaires and an effect controller that controls a lighting effect of each luminaire corresponding to a lighting button selected by a lighting button selector is known (for example, see Japanese Unexamined Patent Application Publication No. 2012-69422). The effect controller sets an effect pattern that causes the luminaires to emit light in sequential order.

Since this effect sequentially turns on one luminaire and turns off another, it gives the illusion that the light is moving.

SUMMARY

With such a dimming control device, in order to control the plurality of luminaires, wiring that connects each luminaire is required. Accordingly, when synchronizing the luminaires, the luminaires need to be wired, requiring a lot of work. Thus, with the conventional dimming control device, configuring the settings is complicated.

In view of this, the present disclosure has an object to provide a luminaire and a lighting control method that can simplify the process of configuring luminaire settings.

In order to achieve the object described above, a luminaire according to one aspect of the present disclosure includes: a light source configured to emit light in a plurality of different colors; a controller that controls the color of the light emitted by the light source; and a plurality of buttons including buttons that correspond one-to-one with the plurality of different colors and are operated by a user to cause the light source to emit light. The controller stores, each time a button among the plurality of buttons corresponding to the plurality of different colors is operated, a control parameter that associates the color corresponding to the button operated with a sequence value indicating a sequential order in which the button is selected, and changes the color of the light emitted by the light source in accordance with the colors and the sequential order indicated in the control parameter that is stored.

A luminaire according to one aspect of the present disclosure includes: a light source; a controller that controls a color of light emitted by the light source; and a plurality of buttons corresponding to different colors of light emitted by the light source. The controller stores a sequential order in which the plurality of buttons are selected and causes the light source to emit light in the colors corresponding to the plurality of buttons selected, in the sequential order that is stored.

A lighting control method according to one aspect of the present disclosure is a method for a luminaire including a light source, a controller that controls a color of light emitted by the light source, and a plurality of buttons that correspond one-to-one with a plurality of different colors and are operated by a user to cause the light source to emit light in the plurality of different colors. The method includes: controlling the color of the light emitted by the light source configured to emit light in the plurality of different colors; storing, each time a button among the plurality of buttons is operated, a control parameter that associates the color corresponding to the button operated with a sequence value indicating a sequential order in which the button is selected; and changing the color of the light emitted by the light source in accordance with the colors and the sequential order indicated in the control parameter that is stored.

According to the present disclosure, it is possible to simplify the configuring of luminaire settings.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Figure 1:
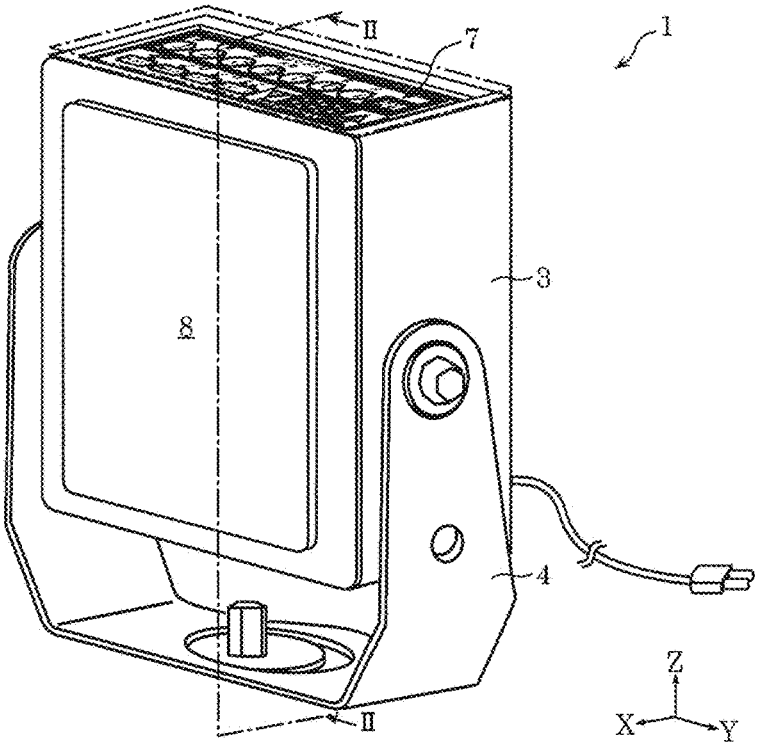
FIG. 1 is a perspective view of a luminaire according to an embodiment.

The following describes an embodiment with reference to the drawings. The embodiment described below shows a preferred, specific example of the present disclosure. The numerical values, shapes, materials, elements, the arrangement and connection of the elements, etc., indicated in the following embodiment are mere examples, and therefore do not intend to limit the present disclosure. Therefore, among elements in the following embodiment, those not recited in any of the broadest, independent claims are described as optional elements.

Moreover, "approximately" means, for example in the case of "approximately the same," not only exactly the same, but what would be recognized as essentially the same as well.

Note that the drawings are represented schematically and are not necessarily precise illustrations. Additionally, like reference signs indicate like elements in the drawings, and repeated descriptions thereof are omitted or simplified.

Hereinafter, a luminaire and a lighting control method according to an embodiment of the present disclosure will be described.

Embodiment (Configuration)

Figure 2:
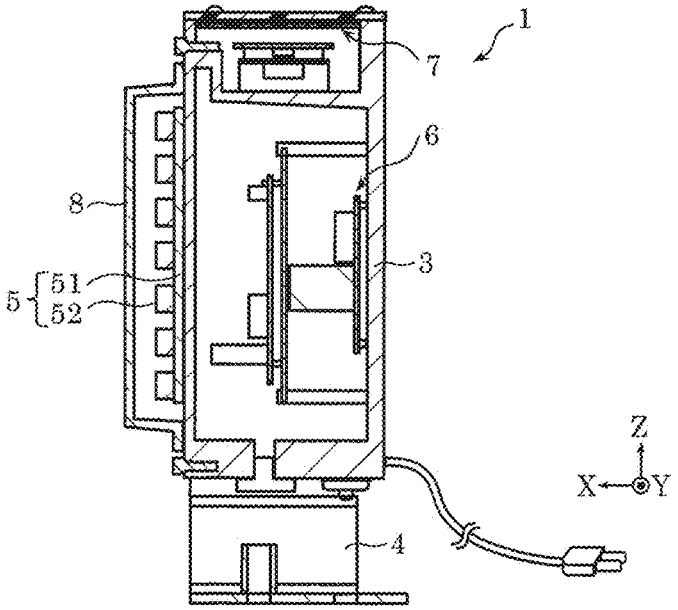
FIG. 2 is a cross-sectional view of the luminaire according to the embodiment, taken at line II-II in FIG. 1.

FIG. 1 is a perspective view of luminaire 1 according to this embodiment. FIG. 2 is a cross-sectional view of luminaire 1 according to this embodiment, taken at line II-II in FIG. 1.

X, Y, and Z directions are shown in FIG. 1. The direction in which luminaire 1 emits light corresponds to the X axis positive direction, the direction from first light emission button 71 toward seventh light emission button 77 corresponds to the Y axis positive direction, and the direction in which input panel 7 is located relative to light source 5 corresponds to the Z axis positive direction. The directions shown in FIG. 1 correspond to the directions shown in FIG. 2. This also applies to the drawings subsequent to FIG. 2, excluding the drawings in which the X, Y, and Z directions are not indicated.

As illustrated in FIG. 1, luminaire 1 is a device that can produce choreographed lighting by emitting light in different colors in different predetermined periods of time. Luminaire 1 is, for example, a flood light or down light. For example, luminaire 1 is attached to a part of a building such as a facility.

Figure 3:
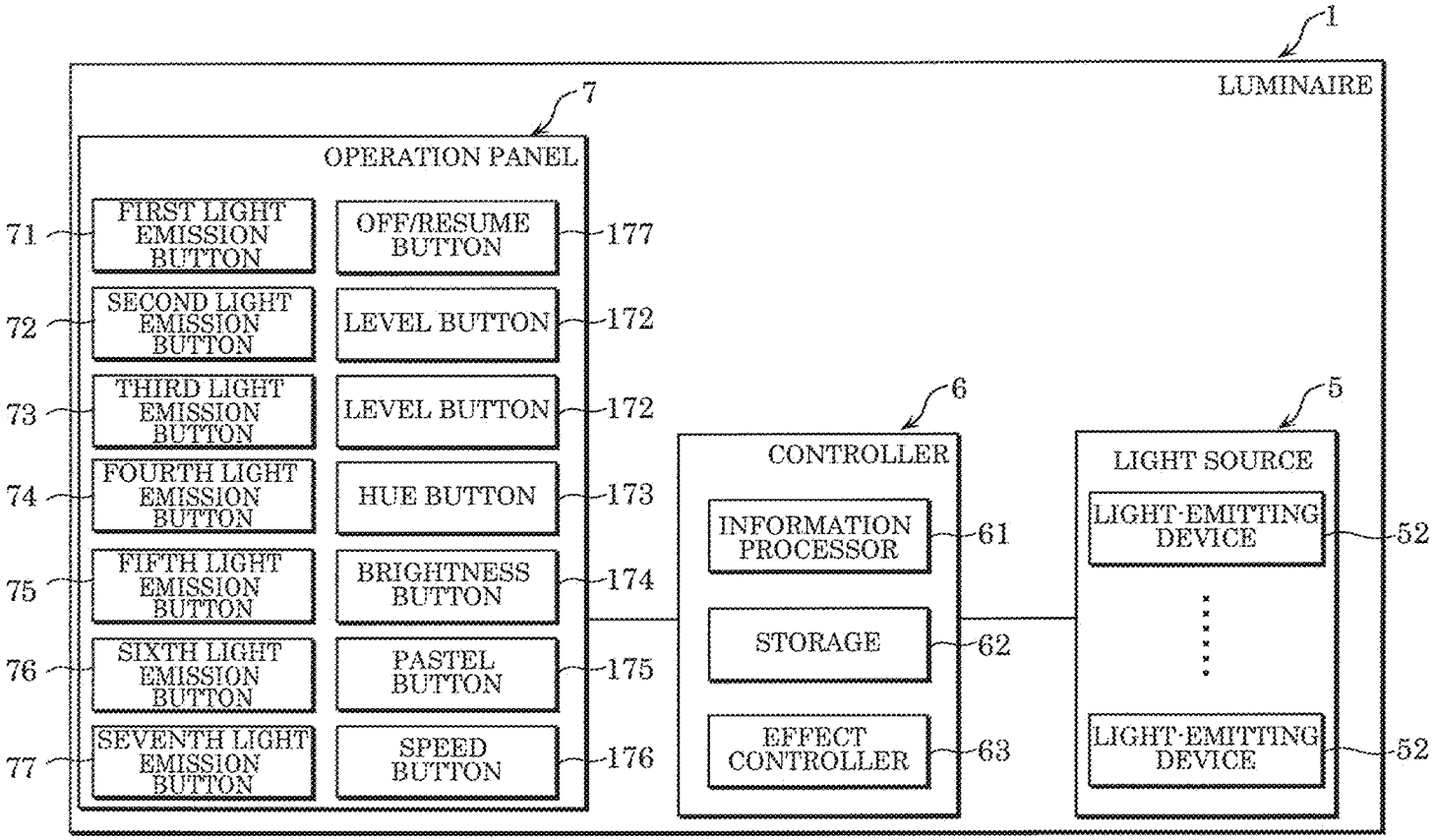
FIG. 3 is a block diagram of the luminaire according to the embodiment.

FIG. 3 is a block diagram of luminaire 1 according to this embodiment.

As illustrated in FIG. 2 and FIG. 3, luminaire 1 includes housing 3, attachment frame 4, light source 5, controller 6, operation panel 7, light-transmissive panel 8, and a power supply box.

Housing 3 is a cuboid box. Housing 3 houses light source 5, controller 6, operation panel 7, and the power supply box. In housing 3, light source 5 is disposed at the X axis positive direction end, and operation panel 7 is disposed at the Z axis positive direction end. Light-transmissive panel 8 is disposed further in the X axis positive direction than light source 5 on housing 3.

As illustrated in FIG. 1, attachment frame 4 is a component for attaching luminaire 1 to a part of a building. Attachment frame 4 is U-shaped in a view of luminaire 1 in the X axis positive direction. Attachment frame 4 is fixed to housing 3 so as to sandwich housing 3 on both Y axis sides. Attachment frame 4 is rotatable relative to housing 3. For example, when luminaire 1 is fixed to a part of a building, housing 3 rotates relative to attachment frame 4. This makes it possible to change the direction in which luminaire 1 emits light.

As illustrated in FIG. 2 and FIG. 3, light source 5 is a module capable of emitting light in a plurality of a different colors, including, for example, red, yellow, green, cyan, blue, magenta, and white. Light source 5 includes substrate 51 and a plurality of light-emitting devices 52.

Substrate 51 is a mounting substrate for mounting light-emitting devices 52, and is, for example, a ceramics substrate, resin substrate, or metal-based substrate covered with an electrical insulation film. In this embodiment, substrate 51 is a low temperature co-fired ceramics (LTCC) package substrate. For example, substrate 51 is a plate-shaped substrate having a flat surface with a rectangular plan-view shape.

Substrate 51 is mounted with a plurality of light-emitting devices 52. Substrate 51 is fixed to the X axis positive direction surface of housing 3 while oriented parallel to the YZ plane.

Light-emitting devices 52 are elements that emit light which is ultimately emitted from luminaire 1. In this embodiment, each light-emitting device 52 is a light-emitting diode (LED) light source, which is a light-emitting module including an LED, that radially emits predetermined light. The plurality of light-emitting devices 52 include red LED chips, green LED chips, and blue LED chips. The light from the red LED chips, green LED chips, and blue LED chips combine to produce various colors of light. For example, each light-emitting device 52 is an LED chip that includes a chip-on-board (COB) type LED and is mounted on substrate 51.

In this embodiment, the plurality of light-emitting devices 52 are mounted on substrate 51 while oriented to emit light in the X axis positive direction. Note that since the orientation in which the plurality of light-emitting devices 52 emit light changes depending on the orientation of housing 3 relative to attachment frame 4, the orientation is not limited to the example given in this embodiment.

As illustrated in FIG. 3, controller 6 includes information processor 61, storage 62, and effect controller 63.

Information processor 61 is a device that performs processing according to an operation made on the operation panel 7. Information processor 61 generates a control parameter each time information processor 61 receives an operation made via operation panel 7, and stores the generated control parameter in storage 62. The control parameter associates the color of the light corresponding to the selected light emission button with a sequence value indicating the sequential order in which the light emission button was selected (to be described later). Stated differently, when information processor 61 receives a string of operations made via operation panel 7, information processor 61 associates the colors of light of light source 5 assigned to operation panel 7 with the sequential order of the selections made on operation panel 7, and stores, in storage 62, the sequential order in which the operations where made each time an operation is made. In this way, information processor 61 stores, in storage 62, the sequential order in which light emission buttons on operation panel 7 are selected, that is to say, the sequential order in which the colors of light are selected. If a new light emission button is selected while the sequential order is stored in storage 62, a sequence value immediately subsequent to the sequence value of the light emission button selected last in the stored sequential order is assigned to the color corresponding to the newly selected light emission button. The light emission buttons are included in the "buttons".

The control parameter is a parameter indicating the sequential order in which a plurality of light emission buttons are selected, expressed as sequence values for colors corresponding to the plurality of light emission buttons. In addition to controlling lighting in the sequential order in which the selected colors of light are selected, the control parameter controls other aspects of the light emitted by light source 5, such as brightness, hue, vividness, and transition period. One iteration of a selection of colors of light is also referred to as one cycle. The selected colors of light mean the colors of light corresponding to the selected light emission buttons.

The color of light emitted by light source 5 that corresponds to a light emission button means the color of light emitted by light source 5 when that light emission button is selected. A selected light emission button means a pressed button, and light source 5 emits light in the color corresponding to that light emission button.

When a light emission button is pressed, information processor 61 determines whether that same light emission button has already been selected and stored as a parameter. When information processor 61 determines that the same light emission button has already been selected, information processor 61 cancels that light emission button stored in storage 62. Light emission button cancellation will be described later.

Information processor 61 determines whether sequence value n is less than or equal to a maximum sequence value in. Each sequence value n indicates the sequential order in which the light emission button is selected. Information processor 61 associates a sequence value n with each light emission button that is selected. For example, when first light emission button 71, second light emission button 72, and third light emission button 73 (to be described later) are selected in the stated order, information processor 61 associates the sequence value n=1 with red light corresponding to first light emission button 71, sequence value n=2 with yellow light corresponding to second light emission button 72, and sequence value n=3 with green light corresponding to third light emission button 73. Information processor 61 generates a control parameter associating red light, yellow light, and green light with the stated sequential order as a single cycle.

Stated differently, information processor 61 assigns numbers to colors of light corresponding to light emission buttons in ascending order of selection. Accordingly, even while lighting is being reproduced in accordance with the control parameter, if another light emission button is selected regardless of when—information processor 61 assigns the next sequence value in ascending order to the selected light emission button.

In response to a user operating operation panel 7, information processor 61 stores, in storage 62, a second value changed from a first value (to be described later). The first and second values indicate at least one of a brightness, hue, vividness, and transition period of the light emitted by light source 5.

When changing the setting for any one of the brightness, hue, vividness, and transition period of the light, information processor 61 once again determines whether operation panel 7 has been operated within a predetermined period beginning when operation panel 7 was last operated. If operation panel 7 is not operated within the predetermined period or longer, it is assumed that the user is finished with making operations. Accordingly, when changing the setting for any one of the brightness, hue, vividness, and transition period of the light, if operation panel 7 is not operated within the predetermined period or longer, information processor 61 finalizes the values displayed on display 171, which displays values indicating the current settings. In this embodiment, the predetermined, period is set to three minutes.

Information processor 61 updates a predetermined value included in the control parameter. Here, a predetermined value indicates at least one of a brightness level, hue level, vividness level, and transition period of light, and is either the first or second value. Note that the determination of whether the predetermined period has elapsed or not may be implemented using a clock that measures time.

Storage 62 is a device that stores a control parameter. Storage 62 may be implemented using, for example, semiconductor memory or a hard disk. Storage 62 retains a control parameter even when luminaire 1 is powered off.

Effect controller 63 controls at least the color of the light emitted by light source 5, the color being one example of a lighting state of light-emitting devices 52 in light source 5. In other words, effect controller 63 changes the color of the light emitted by light source 5 in accordance with the colors corresponding to the sequential order indicated by the stored control parameter.

Effect controller 63 further controls a first value indicating at least one of a brightness, hue, vividness, and transition period of the light emitted by light source 5. When the first value is changed to the second value in response to a user operating operation panel 7, effect controller 63 changes the light emitted by light source 5 based on the second value.

The first value is, for example, a first brightness, first hue, first vividness, and/or first transition period of light. The second value is different from the first value, and is, for example, a second brightness, second hue, second vividness, and/or second transition period of light. In this embodiment, the first value indicates a brightness, hue, vividness, and transition period of light before a change, and the second value indicates a brightness, hue, vividness, and transition period of light after the change.

For example, to change the brightness of the light emitted by light source 5 from a first brightness to a second brightness, effect controller 63 changes the dimming rate of the light emitted by light source 5 to the second value. For example, to change the hue of the light emitted by light source 5 from a first hue to a second hue, effect controller 63 adjusts the color of the light emitted by light source 5 to the second value. For example, to change the vividness of the light emitted by light source 5 from a first vividness to a second vividness, effect controller 63 adjusts the light emitted by light source 5 to the second value.

Effect controller 63 continuously changes the color of the light emitted by light source 5 from a first color to a second color over a predetermined transition period. Effect controller 63 arbitrarily sets the transition period during which the light is continuously changed in response to a user operating operation panel 7. In this embodiment, effect controller 63 can arbitrarily change the transition period that is indicated in the control parameter and during which the color of the light is transitioned from the first color to the second color. Moreover, settings relating to the playback time for a single cycle, which is indicated in the control parameter, can be changed via speed button 176 and level buttons 172 (to be described later) on operation panel 7. Speed button 176 and level buttons 172 are included in the "buttons".

Even when luminaire 1 is powered off, effect controller 63 retains the control parameter. Once luminaire 1 is powered back on, the color of the light emitted by light source 5 is changed in the sequential order indicated in the stored control parameter. Stated differently, once a control, parameter is generated, it is not lost even if luminaire 1 is powered off.

In this way, during operation of operation panel 7, controller 6 causes light source 5 to emit light and stores a control parameter based on an instruction from operation panel 7 into storage 62. More specifically, during operation of the light emission buttons by the user, effect controller 63 causes light source 5 to emit light in the color corresponding to the light emission button being operated and at the set brightness, and information processor 61 stores a control parameter according to the operations made on operation panel 7 into storage 62. Accordingly, controller 6 performs the processes for the storing of the control parameter and the lighting of light source 5 in parallel.

Figure 4:
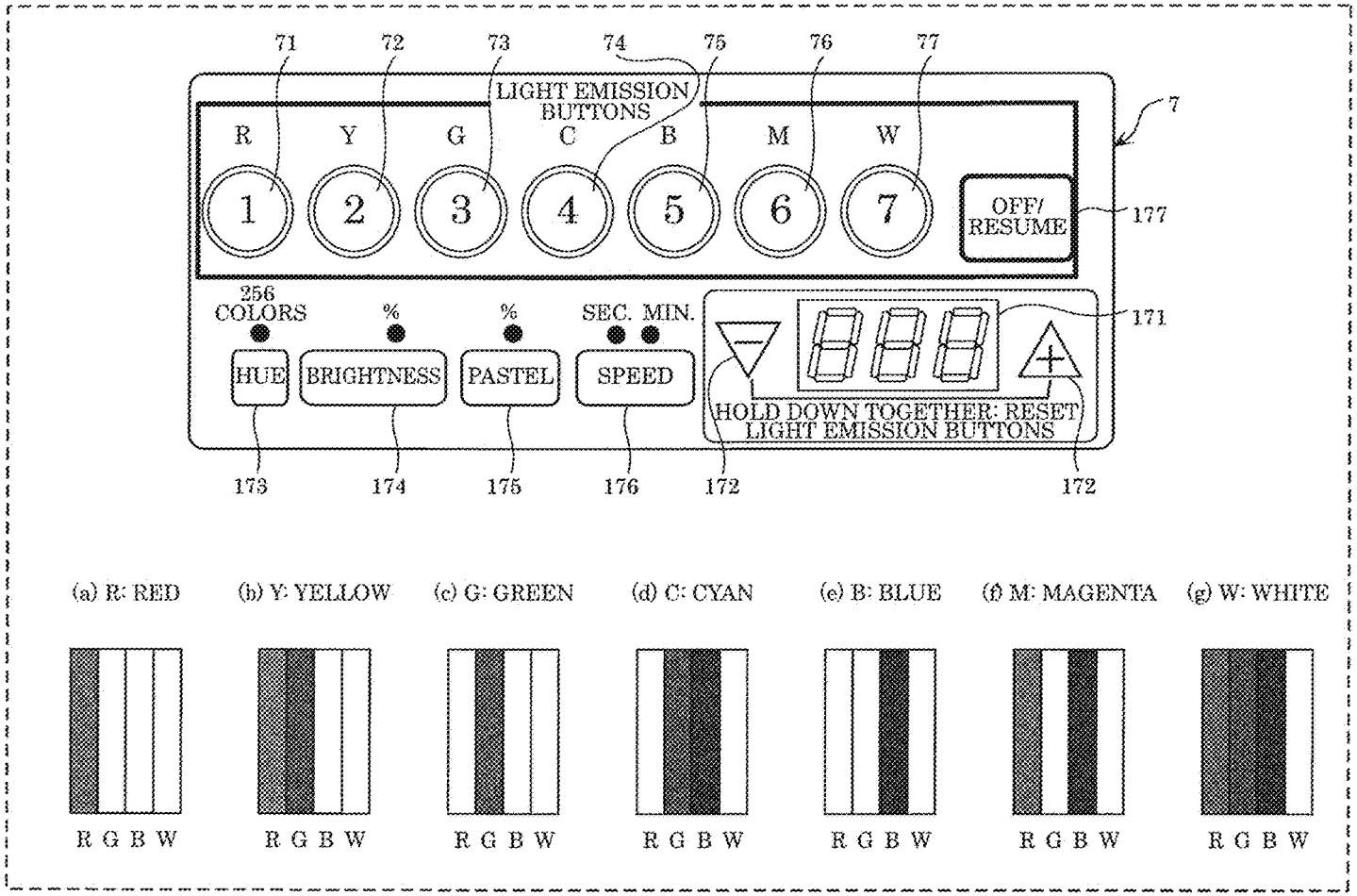
FIG. 4 schematically illustrates an operation panel on the luminaire according to the embodiment and the colors of light corresponding to first through seventh light emission buttons.

FIG. 4 schematically illustrates operation panel 7 on luminaire 1 according to this embodiment and the colors of light corresponding to first light emission button 71 through seventh light emission button 77.

As illustrated in FIG. 4, the lighting state of luminaire 1 can be set via operation panel 7. Operation panel 7 is disposed on the surface of housing 3 located in the Z axis positive direction. Operation panel 7 includes first light emission button 71 through seventh light emission button 77 operable by a user to cause light source 5 to emit light in different colors. Each of first light emission button 71 through seventh light emission button 77 corresponds to a different color. Operation panel 7 instructs controller 6 to control the color of the light emitted by light source 5.

Operation panel 7 includes a plurality of light emission buttons, display 171, two level buttons 172, hue button 173, brightness button 174, pastel button 175, speed button 176, and off/resume button 177. In this embodiment, the plurality of light emission buttons are first light emission button 71 through seventh light emission button 77. Hereinafter, when collectively referring to first light emission button 71 through seventh light emission button 77 or when referring to any given one of first light emission button 71 through seventh light emission button 77, the term "light emission button" will simply be used.

First light emission button 71 is a button for causing light source 5 to emit red light. Red light is indicated as preset color (a). Second light emission button 72 is a button for causing light source 5 to emit yellow light. Yellow light is a mix of red and green light, and is indicated as preset color (b). Third light emission button 73 is a button for causing light source 5 to emit green light. Green light is indicated as preset color (c). Fourth light emission button 74 is a button for causing light source 5 to emit cyan light. Cyan light is a mix of green and blue light, and is indicated as preset color (d). Fifth light emission button 75 is a button for causing light source 5 to emit blue light. Blue light is indicated as preset color (e). Sixth light emission button 76 is a button for causing light source 5 to emit magenta light. Magenta light is a mix of red and blue light, and is indicated as preset color (f). Seventh light emission button 77 is a button for causing light source 5 to emit white light. White light is a mix of red, green, and blue light, and is indicated as preset color (g). First light emission button 71 through seventh light emission button 77 are each an example of a "button".

Level buttons 172 are buttons that can change the hue, brightness, vividness, and transition period levels for the light emitted by light source 5. Level buttons 172 include a button for increasing and a button for decreasing the hue, brightness, and vividness levels of the light emitted by light source 5. The buttons for increasing and decreasing the levels included in level buttons 172 also change the length of the transition period. Level buttons 172 are each one example of a "button".

Display 171 is a panel that displays the hue, brightness, vividness, and transition period of the light emitted by light source 5. Display 171 is, for example, a seven-segment display or liquid crystal display.

Hue button 173 is a button capable of changing the current settings related to the colors corresponding to first light emission button 71 through seventh light emission button 77. For example, using first light emission button 71 as an example, when a user wants to change the color of light corresponding to the first button to yellow, the user can select hue button 173 and change the color of the light using level buttons 172. In such cases, controller 6 updates the control parameter to reflect that the color of light corresponding to the first button is yellow, and stores the updated control parameter in storage 62. Note the colors of light corresponding to second light emission button 72 through seventh light emission button 77 can also be changed in a similar manner. Hue button 173 is one example of a "button".

Brightness button 174 is a button capable of changing settings relating to the brightness of the light emitted by the light source. For example, using an example in which only first light emission button 71 and second light emission button 72 are selected, when a user wants to change the brightness of the light emitted by light source 5, the user selects brightness button 174 and changes the brightness of light using level buttons 172 to change the settings relating to the brightness of the light emitted by light source 5 and corresponding to first light emission button 71 and second light emission button 72. When the brightness of the light emitted by light source 5 and corresponding to first light emission button 71 and second light emission button 72 is set in this manner, controller 6 updates the control parameter and stores the updated control parameter in storage 62. Brightness button 174 is one example of a "button".

Note that brightness button 174 changes the brightness setting for all light emitted by light source 5 simultaneously, and does not individually set the brightness for each color of light corresponding to the different light emission buttons.

Pastel button 175 is a button capable of changing settings relating to the vividness of light emitted by the light source, and is for setting a neutral color. For example, using first light emission button 71 as an example, when a user wants to change the vividness of the light emitted by light source 5, the user can select pastel button 175 and change the vividness of the light using level buttons 172. When the vividness of the light emitted by light source 5 and corresponding to first light emission button 71 is set in this manner, controller 6 updates the control parameter and stores the updated control parameter in storage 62. Pastel button 175 is one example of a "button".

Speed button 176 is a button capable of changing settings relating to the length of one cycle. For example, using first light emission button 71 as an example, when a user wants to change the length of one cycle, the user selects speed button 176 and changes the length of one cycle using level buttons 172. It is possible to set the length in units of seconds or minutes using level buttons 172. When the length of one cycle is set in this manner, controller 6 updates the control parameter and stores the updated control parameter in storage 62. Speed button 176 is one example of a "button".

Off/resume button 177 is a button for reproducing the control parameter stored in storage 62 or turning of light source 5. Stated differently, off/resume button 177 causes luminaire 1 to reproduce the lighting state indicated in the control parameter stored in storage 62.

Next, the cancelling of a light emission button will be described by way of example. When first light emission button 71, second light emission button 72, and third light emission button 73 are selected in the stated order, and second light emission button 72 is subsequently selected again, information processor 61 cancels the emission of light in the color corresponding to second light emission button 72 by light source 5. In this case, as a result, it will be as if first light emission button 71 and third light emission button 73 are selected in the stated order. In other words, information processor 61 generates a control parameter for one cycle that associates red light corresponding to first light emission button 71 and green light corresponding to third light emission button 73 with the stated order, and stores the generated control parameter in storage 62. Light is iteratively emitted while continuously changing between red and green. Moreover, in this case, as a result of a light emission button being canceled, the sequence value for third light emission button 73 selected after the canceled second light emission button 2 is advanced by 1. Note that this is merely one, non-limiting example. The color of the light continuously changing means the color of the light continuously transitions from a first point (color) to a second point (color) along a straight line in a chromaticity diagram.

Light-transmissive panel 8 is a panel with light transmitting properties that transmits light emitted by light source 5. Light-transmissive panel 8 is arranged on the X axis positive direction end of housing 3. Light-transmissive panel 8 covers light source 5 in a view of luminaire 1 from the X axis positive direction side of luminaire 1.

The power supply box is a power supply circuit electrically connected to light source 5, and forms the power supply for luminaire 1. For example, the power supply box includes a printed circuit board and electronic components mounted on the printed circuit board. The power supply box also includes, for example, a dimming circuit and a step-up circuit as assemblies.

(Operations)

Next, operations performed by luminaire 1 according to this embodiment will be described.

Figure 5:
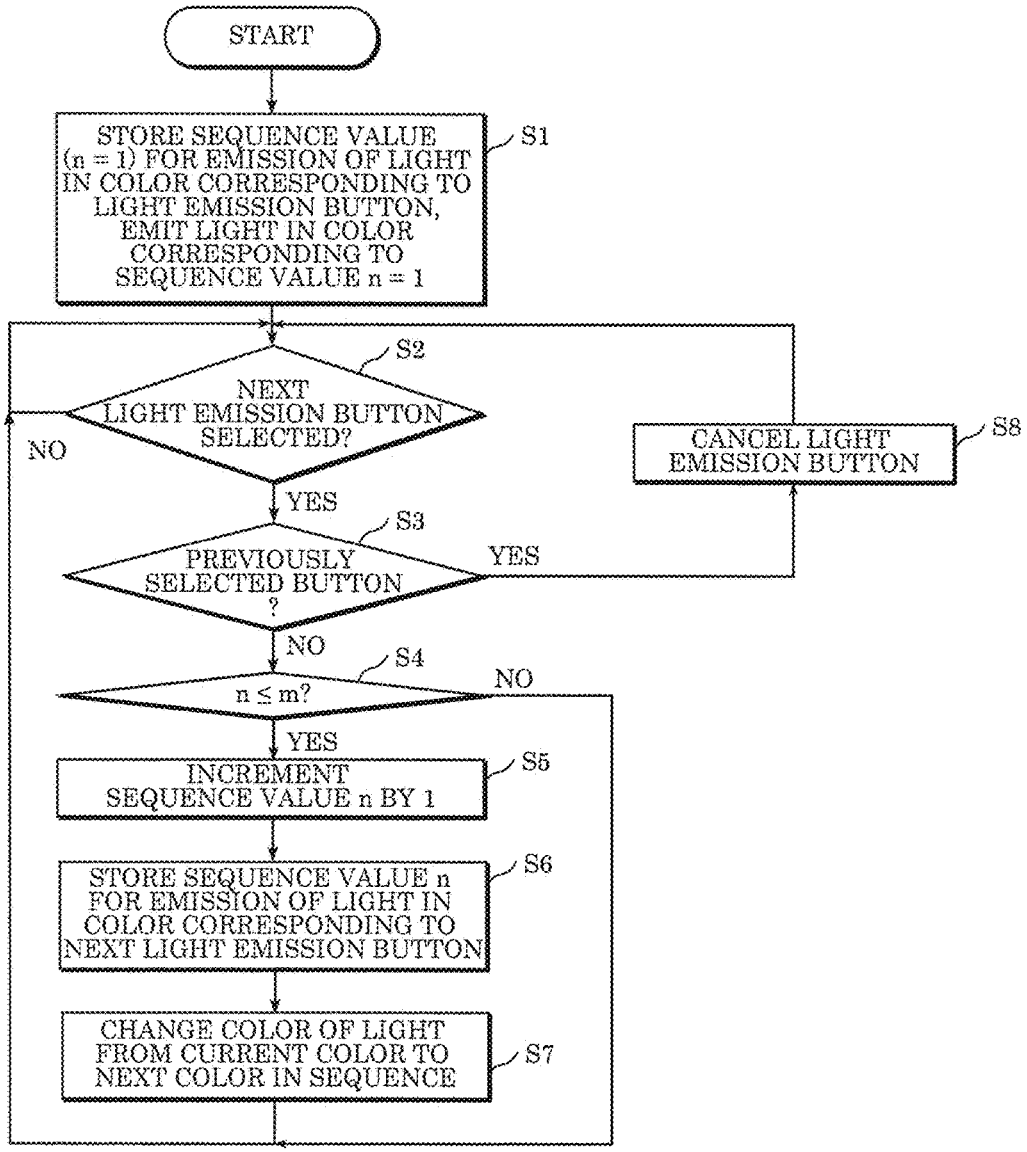
FIG. 5 is a flow chart of operations performed by the luminaire according to the embodiment.

FIG. 5 is a flow chart of operations performed by luminaire 1 according to this embodiment. FIG. 5 describes a user configuring settings for choreographed lighting via luminaire 1.

As illustrated in FIG. 5, first, the user powers on luminaire 1 so as to activate luminaire 1. The user selects a light emission button on operation panel 7. Information processor 61 in controller 6 stores into storage 62 the sequence value for emission of light in the color corresponding to the selected button (S1). The sequence value for emission of light by light source 5 in the color corresponding to the light emission button is n=1, where "1" means "first". Information processor 61 generates a control parameter including the color of light corresponding to the light emission button and the sequence value n=1 associated with the color, and stores the generated control parameter in storage 62.

Effect controller 63 in controller 6 causes light source 5 to emit light in the color corresponding to the selected light emission button (S1). Stated differently, upon a light emission button being selected, controller 6 causes light source 5 to emit light in the color corresponding to the light emission button and stores a control parameter generated at the same time as the light emission button is selected or approximately the same time into storage 62.

Next, the user selects the next light emission button. Information processor 61 determines whether the next light emission button has been selected or not based on whether a signal is obtained as a result of a light emission button being selected or not (S2).

When the next light emission button has not been selected (NO in S2), information processor 61 returns to step S2.

When the next light emission button has been selected (YES in S2), information processor 61 determines whether the light emission button selected in step S1 has been pressed once again or not (S3).

When the same light emission button has already been selected (YES in S3), information processor 61 cancels the pressed light emission button (S8). Stated differently, information processor 61 cancels the selected light emission button from the control parameter stored in storage 62, and advances the sequence values after the color of light corresponding to the canceled light emission button by the number of light emission buttons canceled. Processing then returns to step S2.

When the same light emission button has not already been selected (NO in S3), this means that a light emission button different from the already selected light emission button(s) was selected, so information processor 61 determines whether sequence value n is less than or equal to maximum sequence value m (S4). In this embodiment, since there are seven light emission buttons, the maximum sequence value that can be set is m=7.

If sequence value n is less than or equal to maximum sequence value m (YES in S4), information processor 61 increments the sequence value n determined in step S1 by 1 (S5). In this case, sequence value n=2.

If sequence value n is not less than or equal to maximum sequence value m (NO in S4), information processor 61 returns to step S2. This means that all light emission buttons have been selected. In such cases, if a selected light emission button is canceled, the sequential order in which the colors of light corresponding to the light emission buttons are emitted can be changed. Note that a light emission button can be canceled even at times when not all of the light emission buttons have been selected; so long as one or more light emission buttons have been selected, a selected light emission button can be canceled.

Next, information processor 61 updates the control parameter stored in step S1 with information associating sequence value n=2 determined in step S5 with the color of the light corresponding to the subsequent light emission button selected in step S2, so as to achieve a lighting state in which the light is emitted in colors corresponding to the light emission buttons, in the sequential order. Controller 6 stores the updated control parameter in storage 62 (S6).

Next, information processor 61 continuously changes the color of the light emitted by light source 5, from the current color to the next color in the sequential order (S7). Then, since the user may press another light emission button, information processor 61 returns to step S2 and repeats the same processes.

With luminaire 1, when a light emission button is selected, controller 6 reproduces a control parameter, snaking it possible to emit light in the set lighting state.

Next, the setting of the color of the light emitted by luminaire 1 will be described in detail.

Figure 6:
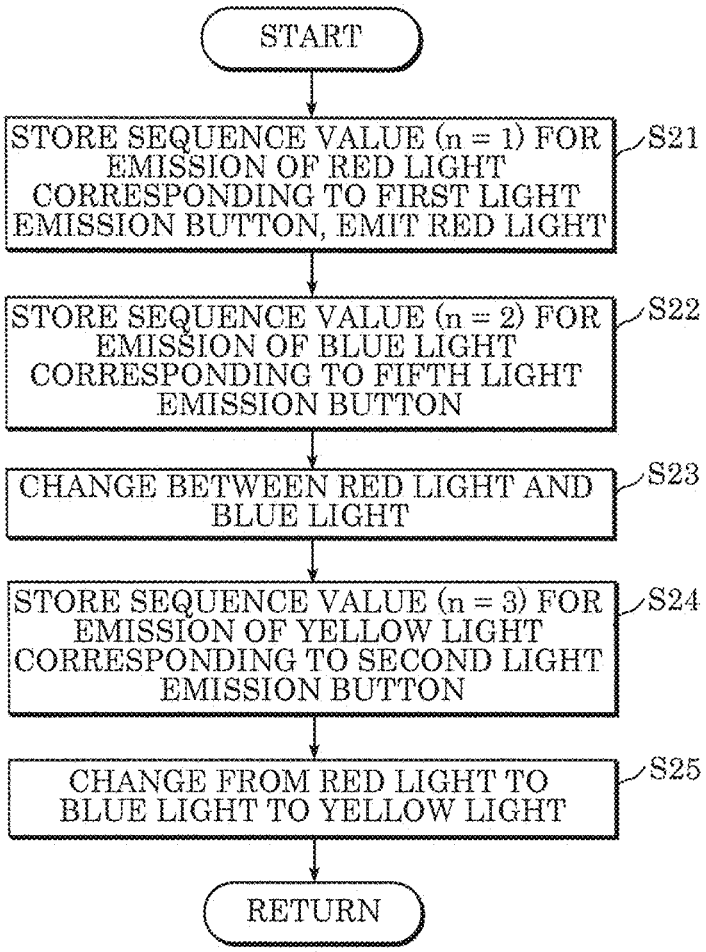
FIG. 6 is a flow chart of the setting of the colors of light emitted by the luminaire according to the embodiment.
Figure 7:
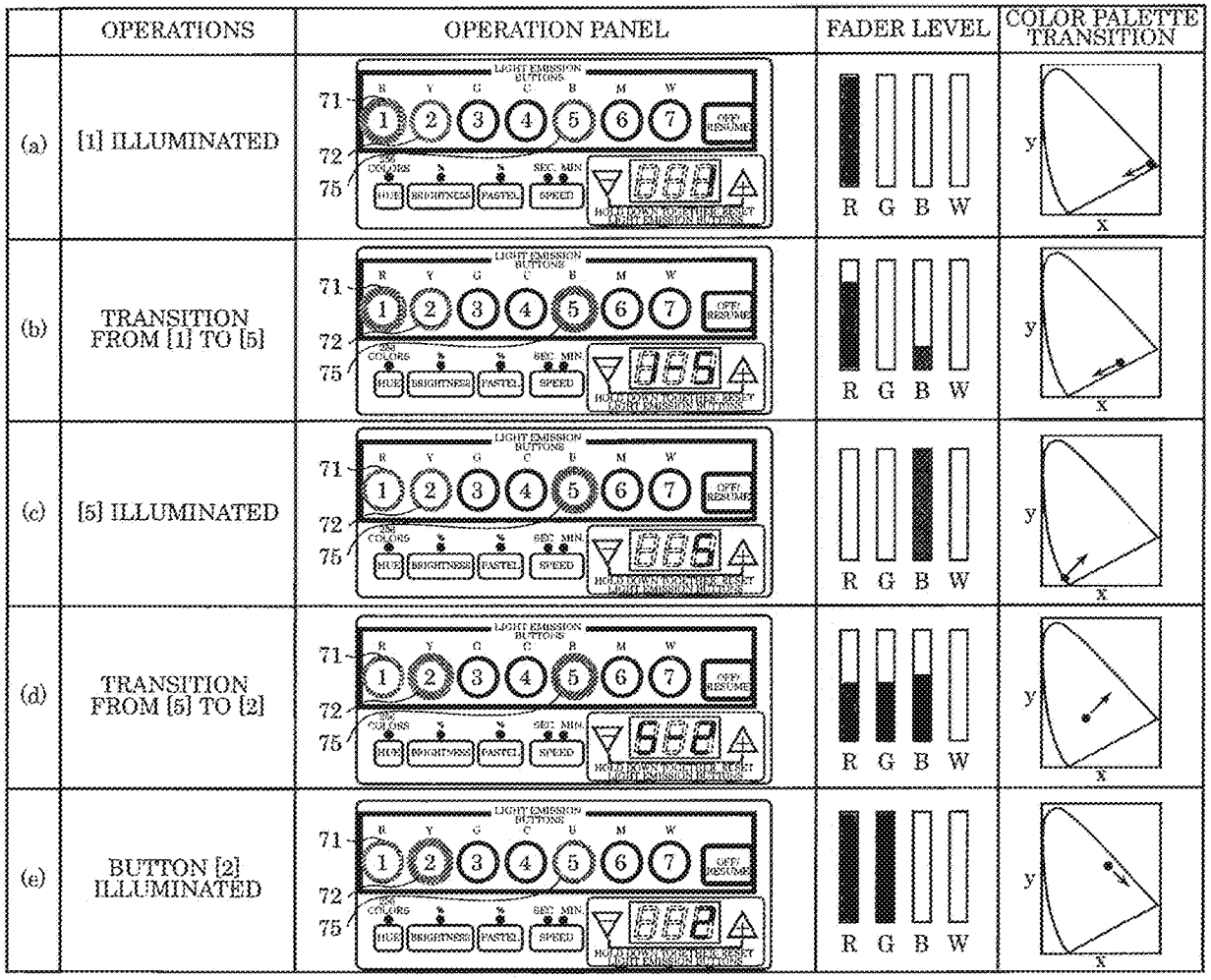
FIG. 7 illustrates the setting of the colors of light emitted by the luminaire according to the embodiment.

FIG. 6 is a flow chart of the setting of the colors of the light emitted by luminaire 1 according to this embodiment. FIG. 7 illustrates the setting of the colors of the light emitted by luminaire 1 according to this embodiment. FIG. 7 illustrates operations performed when light emission buttons are pressed, and illustrates fader levels and color palette transitions for the colors of light emitted by light source 5. The arrows indicate the directions of change in light emitted by light source 5.

First, the user selects first light emission button 71 on operation panel 7. As illustrated in FIG. 6, information processor 61 generates a control parameter indicating that red light is to be emitted by light source 5 at sequence value n=1, and stores the generated control parameter in storage 62 (S21). Moreover, effect controller 63 causes light source 5 to emit red light corresponding to first light emission button 71

(S21). Upon first light emission button 71 being selected, information processor 61 causes light source 5 to emit red light and generates a control parameter associating the red light with sequence value n=1 at which the red light is to be emitted, and stores the control parameter in storage 62.

Here, as illustrated in FIG. 7, first light emission button 71 on operation panel 7 emits light. In row (a) in FIG. 7, the red light is illustrated via fader level and color palette transition.

Next, as illustrated in FIG. 6, the user selects fifth light emission button 75 on operation panel 7. Effect controller 63 causes light source 5 to emit blue light corresponding to the selected fifth light emission button 75. Information processor 61 updates the already generated control parameter to indicate that the blue light is associated with sequence value n=2. Information processor 61 stores the updated control parameter in storage 62 (S22).

Next, as illustrated in FIG. 6, effect controller 63 continuously changes the color of the light being emitted by light source 5 from red to blue over a predetermined transition period, and continuously changes the color of light from blue to red over a predetermined transition period (S23). In other words, the color of the light emitted by light source 5 continuously transitions from red to blue.

Here, as illustrated in FIG. 7, fifth light emission button 75 on operation panel 7 also emits light. In rows (b) and (c) in FIG. 7, the transition from red to blue light is illustrated via fader level and color palette transition.

Note that once light source 5 stops emitting red light, the brightness of the light emitted by first light emission button 71 decreases. The brightness of the light emitted by first light emission button 71 may change in conjunction with the brightness of the red light emitted by tight source 5. In other words, when the amount of red light emitted by light source 5 is high, the brightness of the light emitted by first light emission button 71 may be high, and, conversely, when the amount of red light emitted by light source 5 is low, the brightness of the light emitted by first light emission button 71 may be low. This also applies to light emission buttons other than first light emission button 71.

Next, the user selects second light emission button 72 on operation panel 7. Effect controller 63 causes light source 5 to emit yellow light corresponding to the selected second light emission button 72. Information processor 61 updates the already generated control parameter to indicate that the yellow light is associated with sequence value n=3. Information processor 61 stores the updated control parameter in storage 62 (S24).

Next, effect controller 63 continuously changes the color of the light emitted by light source 5 from red to blue to yellow, in the stated order (S25). More specifically, effect controller 63 continuously changes the color of the light emitted by light source 5 from red to blue over a predetermined transition period, continuously changes the color of the light from blue to yellow over a predetermined transition period, and further continuously changes the color of the light from yellow to red over a predetermined transition period. This single cycle of a string of three changes is repeated.

Here, as illustrated in FIG. 7, second light emission button 72 on operation panel 7 also emits light. In rows (a) through (e) in FIG. 7, the single cycle of the continuous change in the color of the light from red to blue to yellow in the stated order is illustrated via fader level and color palette transition.

For example, when the user ends the configuration of these settings, the processing ends. In this way, with luminaire 1, light source 5 emits light in colors in accordance with the recorded order of the selection, of the light emission buttons. Moreover, luminaire 1 can produce choreographed lighting by iteratively emitting red, blue, and yellow light in the stated order.

Next, the setting of the brightness of the light emitted by luminaire 1 will be described in detail.

Figure 8:
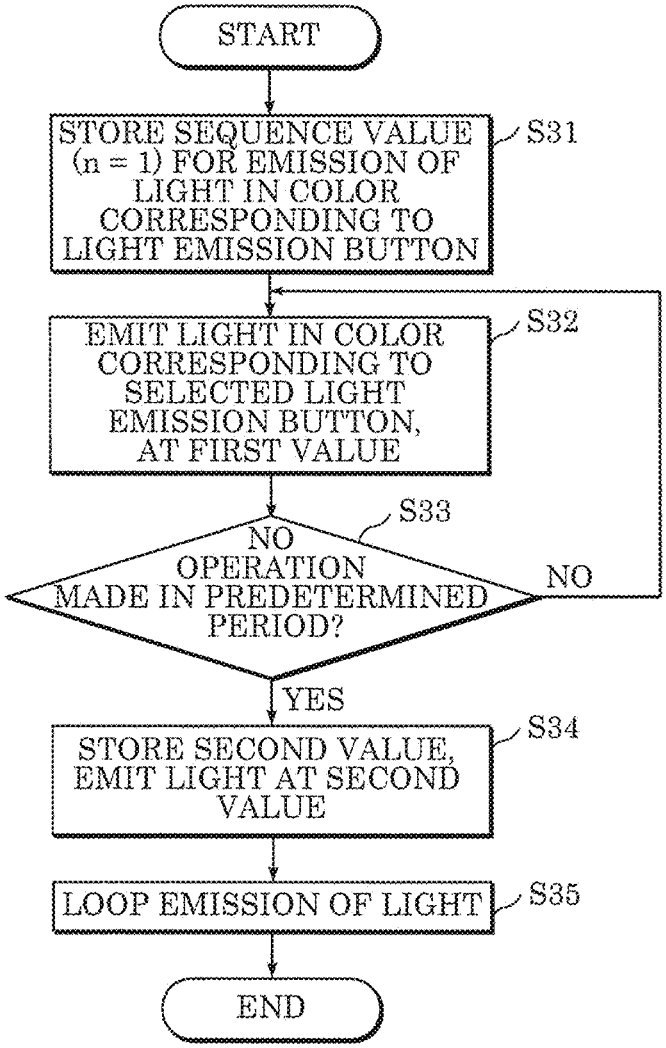
FIG. 8 is a flow chart of the setting of the brightness of light emitted by the luminaire according to the embodiment.

FIG. 8 is a flow chart of the setting of the brightness of the light emitted by luminaire 1 according to this embodiment.

First, as illustrated in FIG. 8, the user selects a light emission button on operation panel 7. Effect controller 63 causes light source 5 to emit light in the color corresponding to the selected light emission button. Information processor 61 generates a control parameter indicating that the color corresponding to the light emission button is to be emitted by light source 5 at sequence value n=1, and stores the generated control parameter in storage 62 (S31).

The user then selects brightness button 174. Information processor 61 enters a mode for changing the brightness of the light corresponding to the selected light emission button. Controller 6 causes light source 5 to emit light at a first brightness according to the level displayed on display 171 (S32). The first brightness is included in the "first value". The user selects a level button 172 to change the first value.

Next, effect controller 63 determines whether operation panel 7 is operated once again within a predetermined period beginning when operation panel 7 was last operated (S33). For example, effect controller 63 determines this based on whether or not a signal is obtained from operation panel 7 within a predetermined period beginning upon receipt of a signal output the last time a light emission button was operated.

When no operation is made within the predetermined period (YES in S33), it is assumed that the user is finished operating the buttons, and information processor 61 updates the first brightness to the second brightness in the control parameter. Information processor 61 stores the updated control parameter in storage 62 (S34). The second brightness is included in the "second value".

When an operation is made within the predetermined period (NO in S33), it is assumed that the user in not finished operating the buttons, and processing returns to step S32.

Effect controller 63 causes light source 5 to iteratively emit light in color(s) according to the control parameter stored in storage 62 (S35). In this way, effect controller 63 changes the brightness of the light in the color corresponding to the selected light emission button from a first brightness to a second brightness, and causes light source 5 to emit light in the color corresponding to the selected button light emission button at the second brightness. Controller 6 then ends this flow of processes.

Next, the setting of the brightness of the light emitted by luminaire 1 will be described by way of example.

Figure 9:
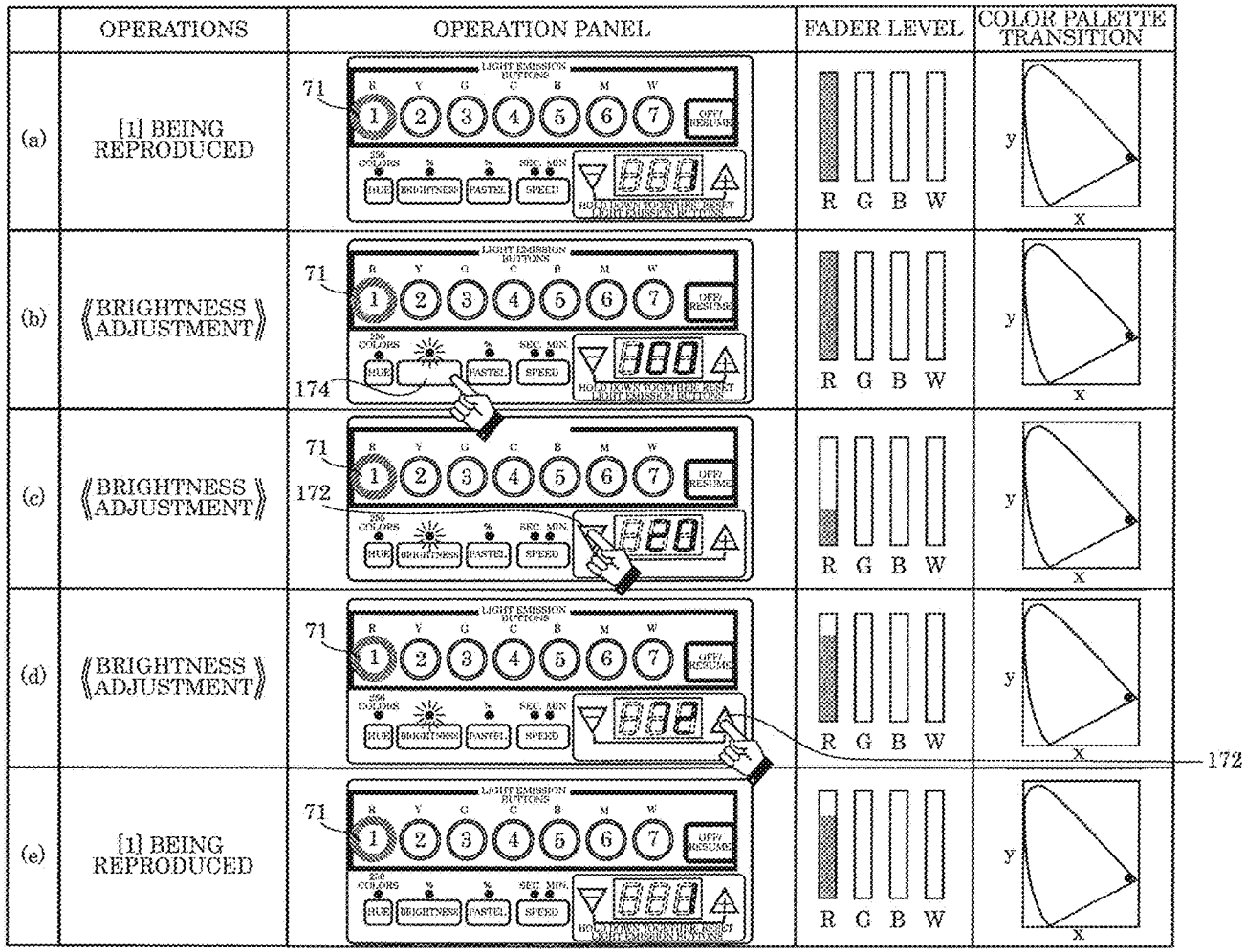
FIG. 9 illustrates the setting of the brightness of light emitted by the luminaire according to the embodiment.

FIG. 9 illustrates the setting of the brightness of the light emitted by luminaire 1 according to this embodiment. In FIG. 9, the selected button is indicated via the hand icon.

In row (a) in FIG. 9, for example, when first light emission button 71 is selected on operation panel 7, effect controller 63 causes light source 5 to emit red light. At this time, information processor 61 causes first light emission button 71 to emit light and generates a control parameter indicating that red light is to be emitted by light source 5 at sequence value n=1. Information processor 61 stores the generated control parameter in storage 62.

When information processor 61 enters the mode for changing the brightness of the light, the level of the first brightness is displayed on display 171, as illustrated in row (b) in FIG. 9. As illustrated in rows (c) and (d) in FIG. 9, the user adjusts the level of the brightness by pressing a level adjustment button while visually confirming the level on display 171. Note that when adjusting the brightness level, effect controller 63 may change the brightness of the red light emitted by light source 5 in conjunction with the brightness level displayed on display 171.

When operation panel 7 is not operated within a predetermined period or when brightness button 174 is pressed again to finalize the setting, effect controller 63 sets the brightness to the second brightness, which is the brightness level displayed on display 171, as illustrated in row (e) in FIG. 9. Information processor 61 updates the first brightness to the second brightness in the control parameter, and stores the updated control parameter in storage 62.

Note that once the brightness level is set, effect controller 63 may continuously change the brightness of the light emitted by light source 5 from the first brightness to the second brightness. In one example, in response to the user operating brightness button 174 and a level adjustment button, effect controller 63 may continuously change the brightness of the light emitted by light source 5 such that the first brightness of 100% of red light continuously changes to the new second brightness setting of 20%.

Next, the setting of the vividness of the color of the light emitted by luminaire 1 will be described by way of example.

Figure 10:
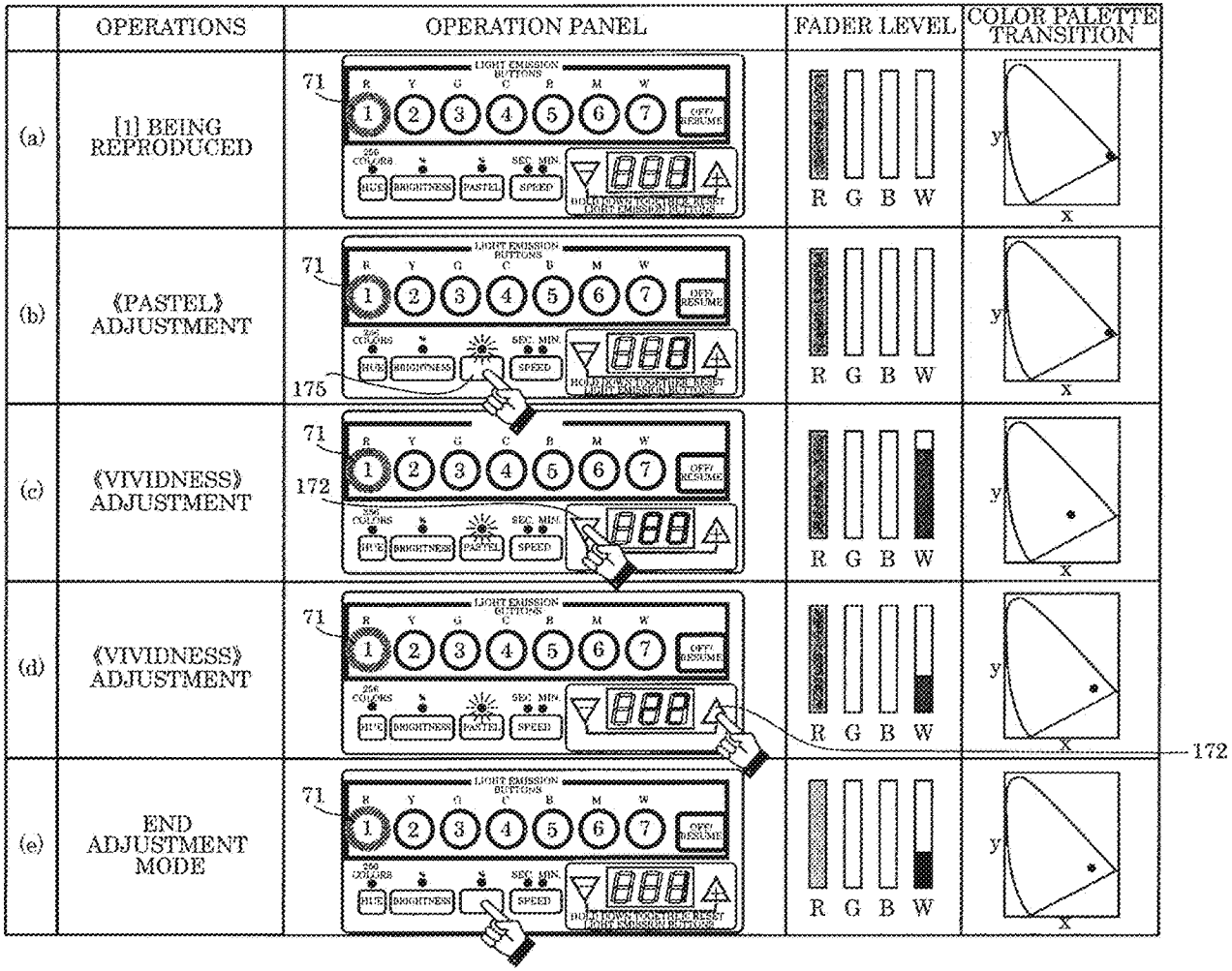
FIG. 10 illustrates the setting of the vividness of light emitted by the luminaire according to the embodiment.

FIG. 10 illustrates the setting of the vividness of the light emitted by luminaire 1 according to this embodiment. In FIG. 10, the selected button is indicated via the hand icon.

In row (a) in FIG. 10, for example, when first light emission button 71 is selected on operation panel 7, effect controller 63 causes light source 5 to emit red light. At this time, information processor 61 causes first light emission button 71 to emit light and generates a control parameter indicating that red light is to be emitted by light source 5 at sequence value n=1. Information processor 61 stores the generated control parameter in storage 62.

When information processor 61 enters the mode for changing the vividness of the light, the level of the first vividness is displayed on display 171, as illustrated in row (b) in FIG. 10. As illustrated in rows (c) and (d) in FIG. 10, the user adjusts the level of vividness by pressing a level adjustment button while visually confirming the level on display 171. Note that when adjusting the vividness level, effect controller 63 may change the vividness of the red light emitted by light source 5 in conjunction with the vividness level displayed on display 171.

When operation panel 7 is not operated within a predetermined period or when pastel button 175 is pressed again to finalize the setting, effect controller 63 sets the vividness to the second vividness, which is the vividness level displayed on display 171, as illustrated in row (e) in FIG. 10. Information processor 61 updates the first vividness to the second vividness in the control parameter, and stores the updated control parameter in storage 62.

Note that once the vividness level is set, effect controller 63 may continuously change the vividness of the light emitted by light source 5 from the first vividness to the second vividness. In one example, in response to the user operating pastel button 175 and a level adjustment button, effect controller 63 may continuously change the vividness of the light emitted by light source 5 such that the first vividness of 100% of red light continuously changes to the new second vividness setting of 20%.

Next, the setting of the speed of the transition period in luminaire 1 will be described by way of example.

Figure 11:
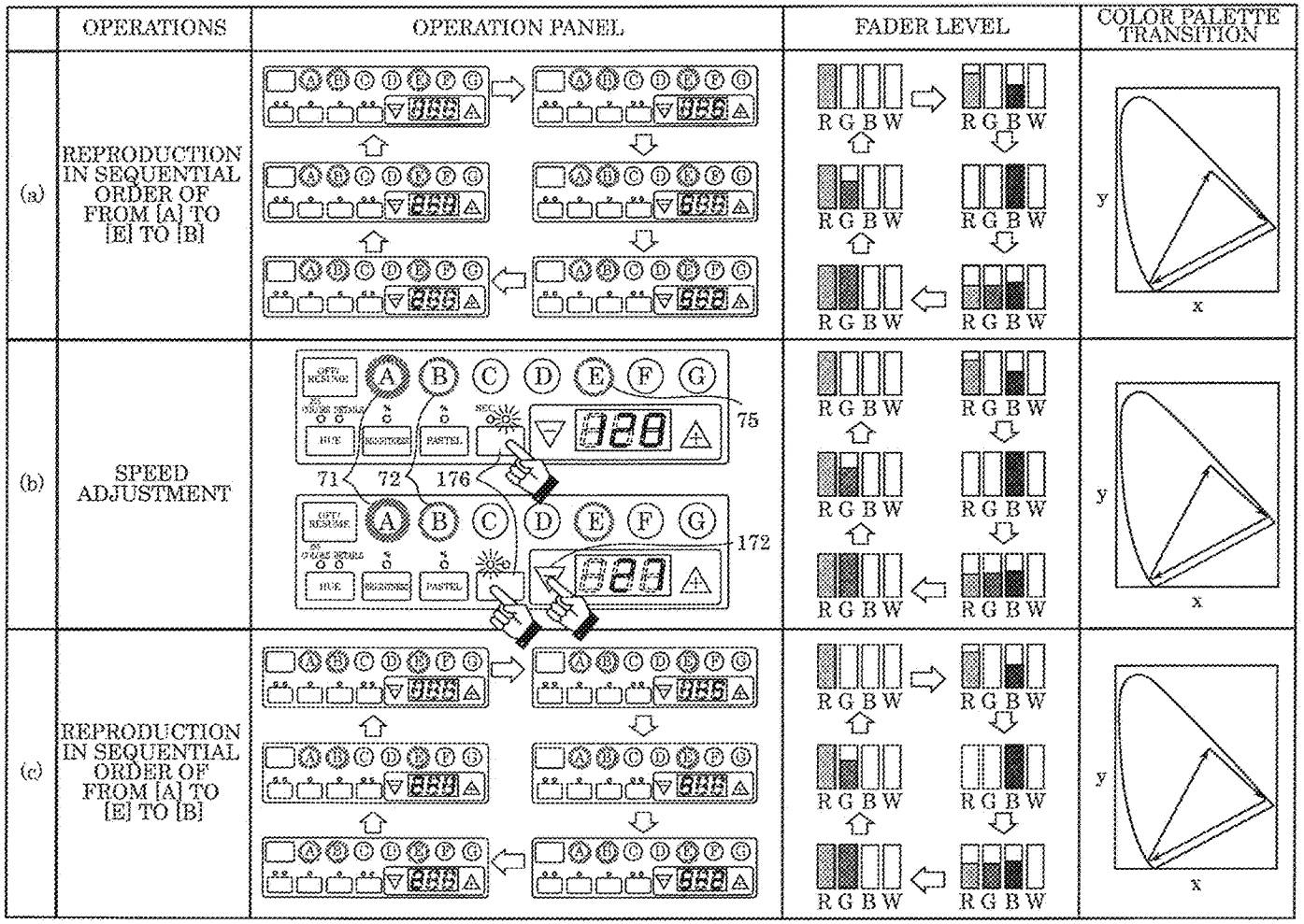
FIG. 11 illustrates the setting of the speed of the transition period in the luminaire according to the embodiment.

FIG. 11 illustrates the setting of the speed of the transition period in luminaire 1 according to this embodiment. FIG. 11 illustrates an example in which red, blue, and yellow light are indicated in the listed order in the control parameter. In FIG. 11, the selected button is indicated via the hand icon.

In row (a) in FIG. 11, first, luminaire 1 cyclically emits light in red, blue, and yellow in the listed order. In this case, as shown in row (b) in FIG. 11, when the user selects speed button 176 on operation panel 7, information processor 61 enters a mode for changing the transition period. Once information processor 61 enters the mode for changing the transition period, the first transition period is displayed on display 171. The user adjusts the transition period by pressing a level adjustment button while visually confirming the level on display 171.

As illustrated in row (c) in FIG. 11, when operation panel 7 is not operated within a predetermined period or when speed button 176 is pressed again to finalize the setting, information processor 61 changes the first transition period displayed on display 171 to a second transition period. Information processor 61 updates the first transition period to the second transition period in the control parameter, and stores the updated control parameter in storage 62. Effect controller 63 causes light source 5 to sequentially change from red to blue light, from blue to yellow light, and from yellow to red light in accordance with the updated transition period.

In one example, when the transition period is set to 120 seconds, one cycle of from red light to blue light to yellow light takes 360 seconds. When the new time is set to 27 minutes, one cycle of from red light to blue light to yellow light takes 81 minutes.

Next, the setting of the hue of the light ed by luminaire 1 will be described by way of example.

Figure 12:
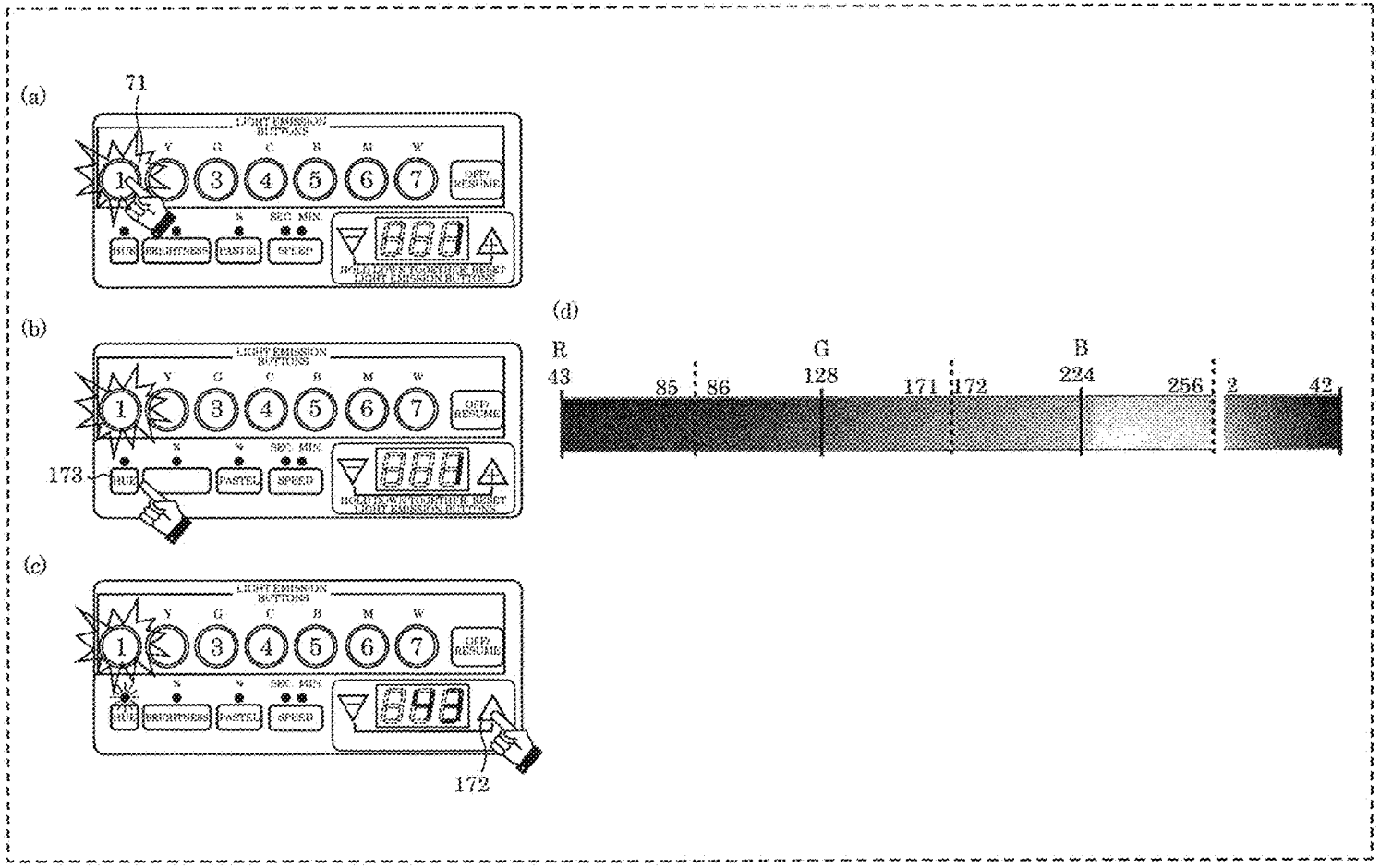
FIG. 12 illustrates the setting of the hue of light emitted by the luminaire according to the embodiment.

FIG. 12 illustrates the setting of the hue of the light emitted by luminaire 1 according to this embodiment. In FIG. 12, the selected button is indicated via the hand icon.

In row (a) in FIG. 12, for example, when first light emission button 71 is selected, information processor 61 causes light source 5 to emit red light. At this time, controller 6 causes first light emission button 71 to emit light and generates a control parameter indicating that red light is to be emitted by light source 5 at sequence value n=1. Information processor 61 stores the generated control parameter in storage 62.

When information processor 61 enters a mode for changing the hue of the light, the level of the first hue is displayed on display 171, as illustrated in rows (b) and (c) in FIG. 12. The user adjusts the hue level by pressing a level adjustment button while visually confirming the level on display 171.

When operation panel 7 is not operated within a predetermined period or when hue button 173 is pressed again to finalize the setting, effect controller 63 sets the hue to the second hue, which is the hue level displayed, on display 171. Information processor 61 updates the hue associated with first light emission button 71 from the first hue to the second hue in control parameter, and stores the updated control parameter in storage 62.

Note that when adjusting the hue level, effect controller 63 may change the hue of the red light emitted by light source 5 in conjunction with the hue level displayed on display 171.

In FIG. 12, (d) illustrates the determining of a hue on a 255 color scale. In one example, as illustrated in (d) in FIG. 12, controller 6 changes the hue of the light emitted by light source 5 such that the setting for the hue of the red light is changed from the first hue of 1 to the new second hue of 224. In other words, the color associated with first light emission button 71 is changed from red to blue. In such cases, two of the light emission buttons on operation panel 7 are associated with causing light source 5 to emit blue light. Although description is omitted, the same applies to the other light emission buttons as well. Note that controller 6 may change the hue of the light from the first hue of 1 to the new second hue of 224 in a continuous manner.

(Operational Advantages)

Next, operational advantages of the lighting control method and luminaire 1 according to this embodiment will be described.

As described above, luminaire 1 according to this embodiment includes light source 5 configured to emit light in a plurality of different colors, controller 6 that controls the color of the light emitted by light source 5, and a plurality of light emission buttons, one for each of the plurality of different colors, operable by a user to cause light source 5 to emit light. Each time one of the light emission buttons is operated, controller 6 stores a control parameter that associates the color corresponding to the light emission button operated with a sequence value indicating a sequential order in which the button is selected, and changes the color of the light emitted by light source 5 in accordance with the colors and the sequential order indicated in the stored control parameter.

With this, each time one of the light emission buttons is operated, controller 6 stores a control parameter that associates the color corresponding to the light emission button operated with a sequence value indicating a sequential order in which the button is selected, and changes the color of the light emitted by light source 5 in accordance with the colors and the sequential order indicated in the stored control parameter. In this way, since the color associated with a light emission button and the sequence value associated with that color can be stored in storage 62 by selecting a light emission button, it is easy to set a lighting state for luminaire 1.

Accordingly, with luminaire 1, it is possible to simplify the configuring of the settings for the luminaire 1.

In particular, with such a luminaire 1, since the settings are configured discretely, there is no need to install wiring for connecting the controller to the luminaire as is the case with the conventional art. Accordingly, installation does not require a lot of work and construction cost can be kept from inflating.

Moreover, luminaire 1 according to this embodiment includes light source 5, controller 6 that controls the color of light emitted by light source 5, and a plurality of light emission buttons corresponding to different colors of light emitted by light source 5. Controller 6 stores the sequential order in which the light emission buttons are selected and causes light source 5 to emit light in colors corresponding to the selected light emission buttons, in the stored sequential order.

Moreover, the lighting control method according to this embodiment is a method for luminaire 1 including light source 5, controller 6 that controls the color of the light emitted by light source 5, and a plurality of light emission buttons that correspond one-to-one with a plurality of different colors and are operated by a user to cause light source 5 to emit light in the plurality of different colors. The lighting control method includes: controlling the color of the light emitted by light source 5 capable of emitting light in the plurality of different colors; storing, each time one of the light emission buttons is operated, a control parameter that associates the color corresponding to the light emission button operated with a sequence value indicating a sequential order in which the button is selected; and changing the color of the light emitted by light source 5 in accordance with the colors and the sequential order indicated in the stored control parameter.

Luminaire 1 and the lighting control method achieve the same operational advantages as described above.

Moreover, in luminaire 1 according to this embodiment, controller 6 continuously changes the color of the light emitted by light source 5 from a first color to a second color over a predetermined transition period.

With this, since controller 6 continuously change the color of the light from a first color to a second color over a predetermined transition period, with luminaire 1, it is possible to realize a smooth transition in color over the transition period. Moreover, by continuously transitioning between two colors, the user is less likely to experience a feeling of strangeness.

Moreover, in luminaire 1 according to this embodiment, controller 6 arbitrarily sets a predetermined transition period in response to the user operating a button.

With this, controller 6 arbitrarily sets the transition period. Accordingly, with luminaire 1, the color of the light emitted by light source 5 can be continuously changed from a first color to a second color over a predetermined transition period, in accordance with a lighting state based on the set transition period. Moreover, with luminaire 1, since it is possible for the user to choreograph lighting according to how luminaire 1 is to be used, luminaire 1 is user friendly.

Moreover, in luminaire 1 according to this embodiment, during operation of a button, controller 6 causes light source 5 to emit light and stores a control parameter based on the operation of the button.

With this, during operation of a button, controller 6 causes light source 5 to emit light and stores a control parameter. Accordingly, during operation of a button by a user, the user can visually confirm the lighting state of light source 5, making it possible to set the lighting state of light source 5 with visual confirmation. Luminaire 1 is therefore user friendly.

Moreover, in luminaire 1 according to this embodiment, controller 6 further controls a first value indicating at least one of the brightness, hue, vividness, and transition period of the light emitted by light source 5. When the user operates a button to change the first value to a second value, controller 6 stores the second value. Controller 6 changes the light emitted by light source 5 based on the second value.

With this, when the user operates a button to change the first value to a second value, controller 6 stores the second value. Controller 6 changes the light emitted by light source 5 based on the second value. By updating the setting for at least one of the hue, brightness, vividness, and transition period of the light in this manner, it is possible to change the light emitted by light source 5 based on the new second value. This makes it possible to improve the degree of freedom related to the configuration of the settings for luminaire 1.

Moreover, in luminaire 1 according to this embodiment, controller 6 retains the control parameter even when luminaire 1 is powered off. Once luminaire 1 is powered back on, the color of the light emitted by light source 5 is changed in the sequential order indicated in the stored control parameter.

With this, controller 6 retains the control parameter even when luminaire 1 is powered off. This makes it possible to reproduce the stored control parameter once luminaire 1 is powered back on. This in turn improves the user friendliness of luminaire 1 since luminaire 1 can emit light in accordance with a lighting state that has already been set.

In luminaire 1 according to this embodiment, the changing of the color of the light emitted by light source 5 is a transition from a first color to a different second color along a straight line in a chromaticity diagram.

In luminaire 1 according to this embodiment, controller 6 iteratively reproduces the control parameter.

In luminaire 1 according to this embodiment, controller 6 includes storage 62 that stores a control parameter. Moreover, storage 62 stores no more than one control parameter.

In luminaire 1 according to this embodiment, when a button that has already been selected is selected again, controller 6 cancels emission of light by light source 5 in the color that corresponds to the button selected, and advances the sequence values later in sequential order than the sequential value associated with the color that was canceled.

(Other Variations, Etc.)

Hereinbefore the present disclosure has been described based on an embodiment, but the present disclosure is not limited to the embodiment described above.

For example, in the luminaire according the embodiment described above, when a plurality of luminaires are used, in cases where the luminaires are to be synchronized, if the power supply is shared among the luminaires, all of the luminaires can be synchronized. In other words, the luminaires can be synchronized by concurrently powering on the luminaires.

In the luminaire according to the embodiment described above, the transition period means refers to a period in which, among two adjacent colors, the color transitions from a first color to a second color, but the transition period may refer to one cycle of all colors of light selected. In such cases, the period may be determined by dividing the transition period by the number of colors selected so as to be divided evenly among all of the selected colors.

In the luminaire according to the embodiment described above, when selecting a plurality of colors, regardless of what color of light the light source is emitting, when the setting for any one of the brightness, vividness, and transition period of the light is changed, for example, the changed setting may be applied to all of the selected colors rather than just any given color among the plurality of selected colors.

In the luminaire according to the embodiment above, when selecting a plurality of colors, if a color is added to the control parameter, the currently set brightness, vividness, transition period for the light is also applied to the newly added color.

Each of the processing units included in the luminaire according to the embodiment described above are typically implemented as an LSI circuit, which is an integrated circuit. Each of these processing units may be individually realized as a single chip, and, alternatively, a portion or all of the processing units may be realized as a single chip.

Moreover, circuit integration is not limited to LSI; the processing units may be realized as dedicated circuits or generic processors. A field programmable gate array (FPGA) that is programmable after manufacturing of the LSI circuit, or a reconfigurable processor whose connections and settings regarding circuit cells in the LSI circuit are reconfigurable, may be used.

Note that in the embodiment described above, each element may be configured in the form of specialized hardware, or may be realized by executing a software program suitable for the element. Each element may be realized by a program executing unit, such as a CPU or a processor, reading and executing the software program recorded on storage such as a hard disk or semiconductor memory.

All of the values used above are mere examples presented for illustrative purposes; the embodiment of the present disclosure is not limited to the exemplary values.

The block diagrams illustrate example of the division of functional blocks; a plurality of functional blocks may be realized as a single functional block, a single functional block may be broken up into a plurality of functional blocks, and part of one function may be transferred to another functional block. The functions of a plurality of function blocks having similar functions may be processed by a single piece of hardware or software in parallel or by time-division.

The order in which the steps are executed in the flow charts are mere examples presented for illustrative purposes; the steps may be executed in a different order. Moreover, some of the steps may be executed at the same time as (i.e., in parallel with) other steps.

Embodiments arrived at by a person skilled in the art making various modifications to the embodiment as well as embodiments realized by arbitrarily combining structural components and functions in the embodiment which do not depart from the essence of the present disclosure are included in the present disclosure.

What is claimed is:

1. A luminaire, comprising:

a light source configured to emit light in a plurality of different colors;

a controller that controls the color of the light emitted by the light source;

a plurality of buttons including buttons that correspond one-to-one with the plurality of different colors and are operated by a user to cause the light source to emit light that changes over time; and a storage, wherein the controller:

generates and stores in the storage, each time a button among the plurality of buttons corresponding to the plurality of different colors is operated, a control parameter that associates the color corresponding to the button operated with a sequence value indicating a sequential order in which the button is selected; and changes the color of the light emitted by the light source over time, in accordance with the colors and the sequential order indicated in the control parameter that is stored in the storage, wherein, the controller updates the control parameter stored in the storage to reflect the control parameter generated each time a button among the plurality of buttons corresponding to the plurality of different colors is operated.

2. The luminaire according to claim 1, wherein the controller continuously changes the color of the light emitted by the light source from a first color to a second color over a predetermined transition period.

3. The luminaire according to claim 1, wherein a change of the color of the light emitted by the light source is a transition from a first color to a second color different from the first color along a straight line in a chromaticity diagram.

4. The luminaire according to claim 3, wherein the first color is a color indicated by the button selected, and the second color is a color indicated by a button that is selected and is different from the button indicating the first color.

5. The luminaire according to claim 4, wherein
the button indicating the second color is selected next in sequence after the button indicating the first color.

6. The luminaire according to claim 5, wherein
each of the first color and the second color is any one of a selected color of light from among red light, yellow light, green light, cyan light, blue light, magenta light, and white light.

7. The luminaire according to claim 1, wherein
the controller arbitrarily sets a predetermined transition period in response to the user operating a button among the plurality of buttons.

8. The luminaire according to claim 1, wherein
during operation of a button among the plurality of buttons, the controller causes the light source to emit light and stores the control parameter based on the operation of the button.

9. The luminaire according to claim 1, wherein
the controller further:
controls a first value indicating at least one of a brightness, a hue, a vividness, and a transition period of the light emitted by the light source;
when the user operates a button among the plurality of buttons to change the first value to a second value, stores the second value; and
changes the light emitted by the light source based on the second value.

10. The luminaire according to claim 1, wherein
the controller retains the control parameter even when the luminaire is powered off, and once the luminaire is powered back on, the controller changes the color of the light emitted by the light source in the sequential order indicated in the control parameter that is stored.

11. The luminaire according to claim 1, wherein
the controller iteratively reproduces the control parameter.

12. The luminaire according to claim 1, wherein
the storage stores no more than one control parameter.

13. The luminaire according to claim 1, wherein
when, among the plurality of buttons corresponding to the plurality of different colors, a button that has already been selected is selected again, the controller cancels emission of light by the light source in the color that corresponds to the button selected, and advances the sequence values later in sequential order than the sequence value associated with the color that was canceled.

14. The luminaire according to claim 1, further comprising:
a housing that houses the light source, the controller, and the plurality of buttons.

15. The luminaire according to claim 14, further comprising:
a power supply box that is housed in the housing and supplies power for causing the light source to emit light.

16. A luminaire, comprising:
a light source that emits light in a plurality of colors that changes over time;
a controller that controls a color of light emitted by the light source;
a plurality of buttons corresponding to different colors of light emitted by the light source; and
a storage,
wherein the controller stores in the storage, each time a button among the plurality of buttons is selected, a sequential order in which the plurality of buttons are selected and causes the light source to emit light in the colors corresponding to the plurality of buttons selected, in the sequential order that is stored in the storage, that changes in color over time.

17. A lighting control method for a luminaire including a light source that emits light in a plurality of colors that changes over time, a controller that controls a color of light emitted by the light source, a plurality of buttons that correspond one-to-one with a plurality of different colors and are operated by a user to cause the light source to emit light in the plurality of different colors, and a storage, the method comprising:
controlling the color of the light emitted by the light source configured to emit light in the plurality of different colors;
generating and storing in the storage, each time a button among the plurality of buttons is operated, a control parameter that associates the color corresponding to the button operated with a sequence value indicating a sequential order in which the button is selected; and
changing the color of the light emitted by the light source over time in accordance with the colors and the sequential order indicated in the control parameter that is stored in the storage.

* * * * *